US006006496A

United States Patent [19]

Weder

[11] Patent Number: 6,006,496

[45] Date of Patent: Dec. 28, 1999

[54] FLORAL SLEEVE CONVERTIBLE INTO A DECORATIVE SKIRT

[75] Inventor: Donald E. Weder, Highland, Ill.

[73] Assignee: Southpac Trust International, Inc.

[21] Appl. No.: 09/004,324

[22] Filed: Jan. 7, 1998

Related U.S. Application Data

[60] Division of application No. 08/781,312, Jan. 9, 1997, abandoned, which is a continuation-in-part of application No. 08/453,719, May 30, 1995, abandoned, which is a continuation of application No. 08/220,852, Mar. 31, 1994, Pat. No. 5,572,851.

[51] Int. Cl.[6] ..... B65B 25/02; B65B 61/18

[52] U.S. Cl. ..... 53/399; 53/390; 53/397; 53/412

[58] Field of Search ..... 53/397, 399, 413, 53/412, 410, 419, 459, 469, 464, 461, 473, 390, 592, 582, 580, 571, 570, 219, 218, 133.8, 133.3, 134.1; 47/72, 66 B, 66 R; 206/423; 383/207, 209; 229/87.01, 87.04, 87.05

[56] References Cited

U.S. PATENT DOCUMENTS

| | | | |
|---|---|---|---|
| Re. 21,065 | 5/1939 | Copeman | 93/2 |
| D. 259,333 | 5/1981 | Charbonneau | D9/306 |
| D. 279,279 | 6/1985 | Wagner | D11/143 |
| D. 301,991 | 7/1989 | Van Sant | D11/149 |
| D. 335,105 | 4/1993 | Ottenwalder et al. | D11/164 |
| D. 368,025 | 3/1996 | Sekerak et al. | D9/305 |
| 524,219 | 8/1894 | Schmidt . | |
| 732,889 | 7/1903 | Paver . | |
| 950,785 | 3/1910 | Pene . | |
| 1,063,154 | 5/1913 | Bergen . | |
| 1,446,563 | 2/1923 | Hughes . | |
| 1,520,647 | 12/1924 | Hennigan . | |
| 1,525,015 | 2/1925 | Weeks . | |
| 1,610,652 | 12/1926 | Bouchard . | |
| 1,697,751 | 1/1929 | Blake | 229/87 |
| 1,863,216 | 6/1932 | Wordingham . | |
| 1,978,631 | 10/1934 | Herrlinger | 91/68 |

(List continued on next page.)

FOREIGN PATENT DOCUMENTS

| | | |
|---|---|---|
| 4231978 | 6/1979 | Australia . |
| 654427 | 1/1965 | Belgium . |
| 0050990 | 5/1982 | European Pat. Off. . |
| 0791543 | 8/1997 | European Pat. Off. . |
| 1376047 | 9/1964 | France . |

(List continued on next page.)

OTHER PUBLICATIONS

"A World of Cut Flower and Pot Plant Packaging" Brochure, Klerk's Plastic Products Manufacturing, Inc., published prior to Mar. 31, 1994, 6 pages.

Chantler & Chantler brochure showing Zipper Sleeve™ and Florasheet®, published prior to Mar. 31, 1994, 2 pages.

"Foil Jackets" brochure, Custom Medallion, Inc., Dec., 1996, 2 pages.

(List continued on next page.)

*Primary Examiner*—James F. Coan

*Attorney, Agent, or Firm*—Dunlap, Codding & Rogers, P.C.

[57] ABSTRACT

A floral sleeve having an upper portion, a lower portion and a medial portion. The floral sleeve can be placed about a plant container such as a potted plant such that the lower portion contains the pot, and the upper portion surrounds the plant. When desired, the upper portion and lower portion can be detached, leaving the medial portion which can be attached to the pot forming a skirt extending from the upper end thereof.

17 Claims, 2 Drawing Sheets

U.S. PATENT DOCUMENTS

| | | | |
|---|---|---|---|
| 2,048,123 | 7/1936 | Howard | 229/87 |
| 2,170,147 | 8/1939 | Lane | 206/56 |
| 2,200,111 | 5/1940 | Bensel | 229/1.5 |
| 2,278,673 | 4/1942 | Savada et al. | 154/43 |
| 2,302,259 | 11/1942 | Rothfuss | 41/10 |
| 2,323,287 | 7/1943 | Amberg | 229/53 |
| 2,355,559 | 8/1944 | Renner | 229/8 |
| 2,371,985 | 3/1945 | Freiberg | 206/46 |
| 2,411,328 | 11/1946 | MacNab | 33/12 |
| 2,510,120 | 6/1950 | Leander | 117/122 |
| 2,529,060 | 11/1950 | Trillich | 117/68.5 |
| 2,621,142 | 12/1952 | Wetherell | 154/117 |
| 2,648,487 | 8/1953 | Linda | 229/55 |
| 2,688,354 | 9/1954 | Berger | 150/28 |
| 2,774,187 | 12/1956 | Smithers | 47/41 |
| 2,822,287 | 2/1958 | Avery | 117/14 |
| 2,846,060 | 8/1958 | Yount | 206/58 |
| 2,850,842 | 9/1958 | Eubank, Jr. | 47/58 |
| 2,883,262 | 4/1959 | Borin | 21/56 |
| 2,989,828 | 6/1961 | Warp | 53/390 |
| 3,022,605 | 2/1962 | Reynolds | 47/58 |
| 3,080,680 | 3/1963 | Reynolds | 47/37 |
| 3,094,810 | 6/1963 | Kalpin | 47/37 |
| 3,121,647 | 2/1964 | Harris et al. | 118/202 |
| 3,130,113 | 4/1964 | Silman | 161/97 |
| 3,271,922 | 9/1966 | Wallerstein et al. | 53/3 |
| 3,322,325 | 5/1967 | Bush | 229/62 |
| 3,376,666 | 4/1968 | Leonard | 47/41 |
| 3,380,646 | 4/1968 | Doyen et al. | 229/57 |
| 3,431,706 | 3/1969 | Stuck | 53/390 |
| 3,508,372 | 4/1970 | Wallerstein et al. | 53/3 |
| 3,510,054 | 5/1970 | Sanni et al. | 229/66 |
| 3,512,700 | 5/1970 | Evans et al. | 229/53 |
| 3,552,059 | 1/1971 | Moore | 47/41.12 |
| 3,554,434 | 1/1971 | Anderson | 229/55 |
| 3,556,389 | 1/1971 | Gregoire | 229/53 |
| 3,557,516 | 1/1971 | Brandt | 53/14 |
| 3,620,366 | 11/1971 | Parkinson | 206/59 |
| 3,681,105 | 8/1972 | Milutin | 117/15 |
| 3,767,104 | 10/1973 | Bachman et al. | 229/7 |
| 3,793,799 | 2/1974 | Howe | 53/32 |
| 3,869,828 | 3/1975 | Matsumoto | 47/34.11 |
| 3,888,443 | 6/1975 | Flanigen | 248/152 |
| 3,962,503 | 6/1976 | Crawford | 428/40 |
| 4,043,077 | 8/1977 | Stonehocker | 47/66 |
| 4,054,697 | 10/1977 | Reed et al. | 428/40 |
| 4,091,925 | 5/1978 | Griffo et al. | 206/423 |
| 4,113,100 | 9/1978 | Soja et al. | 206/602 |
| 4,118,890 | 10/1978 | Shore | 47/28 |
| 4,189,868 | 2/1980 | Tymchuck et al. | 47/84 |
| 4,216,620 | 8/1980 | Weder et al. | 47/72 |
| 4,248,347 | 2/1981 | Trimbee | 206/423 |
| 4,265,049 | 5/1981 | Gorewitz | 47/26 |
| 4,280,314 | 7/1981 | Stuck | 53/241 |
| 4,297,811 | 11/1981 | Weder | 47/72 |
| 4,333,267 | 6/1982 | Witte | 47/84 |
| 4,347,686 | 9/1982 | Wood | 47/73 |
| 4,380,564 | 4/1983 | Cancio et al. | 428/167 |
| 4,400,910 | 8/1983 | Koudstall et al. | 47/84 |
| 4,413,725 | 11/1983 | Bruno et al. | 206/45.33 |
| 4,546,875 | 10/1985 | Zweber | 206/0.82 |
| 4,621,733 | 11/1986 | Harris | 206/423 |
| 4,640,079 | 2/1987 | Stuck | 53/390 |
| 4,717,262 | 1/1988 | Roen et al. | 383/120 |
| 4,733,521 | 3/1988 | Weder et al. | 53/580 |
| 4,765,464 | 8/1988 | Ristvedt | 206/0.82 |
| 4,771,573 | 9/1988 | Stengel | 47/67 |
| 4,773,182 | 9/1988 | Weder et al. | 47/72 |
| 4,801,014 | 1/1989 | Meadows | 206/423 |
| 4,810,109 | 3/1989 | Castel | 383/105 |
| 4,835,834 | 6/1989 | Weder | 29/525 |
| 4,941,572 | 7/1990 | Harris | 206/423 |
| 4,980,209 | 12/1990 | Hill | 428/34.1 |
| 5,073,161 | 12/1991 | Weder et al. | 493/154 |
| 5,074,675 | 12/1991 | Osgood | 383/122 |
| 5,105,599 | 4/1992 | Weder | 53/399 |
| 5,111,638 | 5/1992 | Weder | 53/397 |
| 5,120,382 | 6/1992 | Weder | 156/212 |
| 5,152,100 | 10/1992 | Weder et al. | 47/72 |
| 5,181,364 | 1/1993 | Weder | 53/397 |
| 5,199,242 | 4/1993 | Weder et al. | 53/397 |
| 5,205,108 | 4/1993 | Weder et al. | 53/397 |
| 5,228,234 | 7/1993 | de Klerk et al. | 47/41.01 |
| 5,235,782 | 8/1993 | Landau | 47/72 |
| 5,239,775 | 8/1993 | Landau | 47/72 |
| 5,249,407 | 10/1993 | Stuck | 53/399 |
| 5,259,106 | 11/1993 | Weder et al. | 29/469.5 |
| 5,307,606 | 5/1994 | Weder | 53/410 |
| 5,315,785 | 5/1994 | Avôt et al. | 47/72 |
| 5,350,240 | 9/1994 | Billman et al. | 383/104 |
| 5,353,575 | 10/1994 | Stepanek | 53/461 |
| 5,361,482 | 11/1994 | Weder et al. | 29/469 |
| 5,388,695 | 2/1995 | Gilbert | 206/423 |
| 5,443,670 | 8/1995 | Landau | 156/191 |
| 5,493,809 | 2/1996 | Weder et al. | 47/72 |
| 5,496,251 | 3/1996 | Cheng | 493/224 |
| 5,496,252 | 3/1996 | Gilbert | 493/224 |
| 5,526,932 | 6/1996 | Weder | 53/397 |
| 5,572,849 | 11/1996 | Weder et al. | 53/397 |
| 5,572,851 | 11/1996 | Weder | 53/399 |
| 5,575,133 | 11/1996 | Weder et al. | 53/397 |
| 5,617,703 | 4/1997 | Weder | 53/413 |
| 5,624,320 | 4/1997 | Martinez | 472/51 |
| 5,647,168 | 7/1997 | Gilbert | 47/72 |

FOREIGN PATENT DOCUMENTS

| | | | |
|---|---|---|---|
| 2036163 | 12/1970 | France . | |
| 2137325 | 12/1972 | France . | |
| 2272914 | 12/1975 | France . | |
| 2489126 | 3/1982 | France . | |
| 2610604 | 8/1988 | France . | |
| 2603159 | 3/1989 | France . | |
| 2619698 | 3/1989 | France . | |
| 345464 | 12/1921 | Germany . | |
| 513971 | 11/1930 | Germany . | |
| 1166692 | 3/1964 | Germany . | |
| 1962947 | 6/1971 | Germany . | |
| 2060812 | 11/1971 | Germany . | |
| 2748626 | 5/1979 | Germany . | |
| 3445799 | 6/1986 | Germany . | |
| 3829281 | 5/1989 | Germany . | |
| 3911847 | 10/1990 | Germany | 47/72 |
| 224507 | 4/1996 | Italy . | |
| 542958 | 2/1993 | Japan . | |
| 8301709 | 12/1984 | Netherlands . | |
| 1000658 | 1/1996 | Netherlands . | |
| 560532 | 4/1975 | Switzerland . | |
| 5605 | of 1885 | United Kingdom . | |
| 1204647 | 9/1970 | United Kingdom . | |
| 2056410 | 3/1981 | United Kingdom . | |
| 2074542 | 11/1981 | United Kingdom . | |
| 2128083 | 4/1984 | United Kingdom . | |
| 2252708 | 8/1992 | United Kingdom . | |
| 9315979 | 8/1993 | WIPO . | |

OTHER PUBLICATIONS

"Derwent Abstract" of FR 2610604A. It is noted that the abstract is an incorrect English translation of the contents of the French patent. The French patent does not enable or disclose adhesively attaching the covering to the container. 1998.

Exhibit A—Speed Cover Brochure, "The Simple Solution For Those Peak Volume Periods", Highland Supply Corporation, ©1989.
Exhibit B—"Speed Sheets and Speed Rolls" Brochure, Highland Supply Corporation, ©1990.
Exhibit C—"Color Them Happy with Highlander Products" ©1992.
Exhibit D—"Costa Keeps the Christmas Spirit", Supermarket Floral, Sep. 15, 1992.
Exhibit E—"Super Seller", Supermarket Floral, Sep. 15, 1992.
Exhibit F—"Halloween", Link Magazine, Sep. 1992, 2 pages.
Exhibit G—"Now More Than Ever", Supermarket Floral, Sep. 15, 1992.
Exhibit H—Le Plant Sac Advertisement, published prior to Sep. 26, 1987.
Exhibit I—"A World of Cut Flower and Pot Plant Packaging" Brochure, Klerk's Plastic Products Manufacturing, Inc., Date unknown, 6 pages.
Exhibit J—Chantler & Chantler brochure showing Zipper Sleeve™ and Florasheet®, Date unknown, 2 pages.

FLORAL SLEEVE CONVERTIBLE INTO A DECORATIVE SKIRT

CROSS REFERENCE TO RELATED APPLICATIONS

The present application is a divisional of U.S. Ser. No. 08/781,312, filed Jan. 9, 1997, now abandoned which is a continuation-in-part of U.S. Ser. No. 08/453,719, filed May 30, 1995, now abandoned, which is a continuation of U.S. Ser. No. 08/220,852, filed Mar. 31, 1994, now U.S. Pat. No. 5,572,851, the specification of which is hereby incorporated by reference herein.

STATEMENT REGARDING FEDERALLY SPONSORED RESEARCH OR DEVELOPMENT

Not Applicable

BACKGROUND OF INVENTION

Floral sleeves have long been used in the floral industry for covering potted plants for protection during shipment. After shipment the sleeves are usually removed and completely discarded. This practice can be wasteful and time consuming. Thus a floral sleeve which could be converted to provide a decorative, as well as protective, effect would be useful.

DESCRIPTION OF THE PREFERRED EMBODIMENTS

Figure 1:
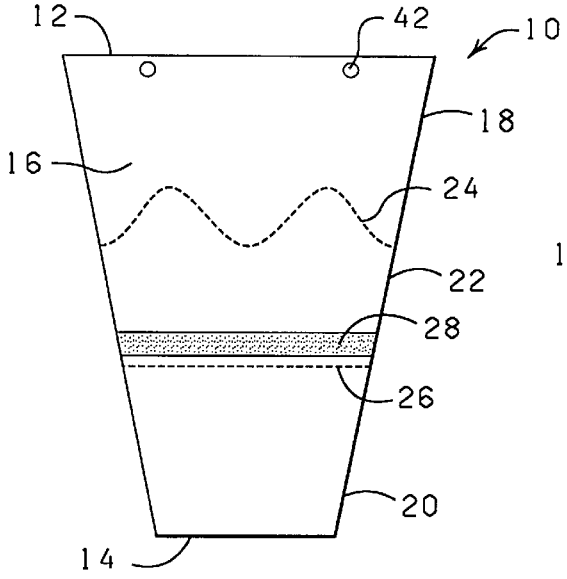
FIG. 1 is a side perspective view of a sleeve constructed in accordance with the present invention.

The present invention contemplates such a floral sleeve wherein a portion of the sleeve can be converted into a skirt for providing both a decorative and functional use of the sleeve.

In one version, the floral sleeve is a wrapper for a plant container, and comprises a flexible tubular sleeve preformed and dimensioned to fit a plant container having a specific size and shape and the sleeve having an upper end, a lower end, an outer peripheral surface, and an inner peripheral surface, and having an upper sleeve portion, a base portion and a medial portion positioned between the upper sleeve portion and the base portion. The upper sleeve portion is detachable from the medial portion via upper detaching means and the base portion is detachable from the medial portion via lower detaching means. The lower detaching means is positioned so that when the plant container is placed within the base portion the lower detaching means is located a distance below an upper rim of the plant container for allowing attachment of a portion of the medial portion to the plant container. When the upper sleeve portion and the base portion are detached from the medial portion, the medial portion is attachable to a surface of the plant container forming a skirt which extends away from the upper rim of the plant container. The upper detaching means and the lower detaching means may comprise perforations. The lower end may be open but is preferably closed. Preferably, the wrapper has a first panel and a second panel forming a tube shape with an interior space and is initially in a flattened condition.

In another version, the invention contemplates a wrapper for a plant container which comprises a flexible tubular sleeve having an upper end, a lower end, an outer peripheral surface, and an inner peripheral surface, and an interior surface, and having an upper sleeve portion, a base portion and a medial portion positioned between the upper sleeve portion and the base portion. The medial portion has a bonding material disposed upon a portion thereof for attaching to a portion of the plant container, and the upper sleeve portion is detachable from the medial portion via first detaching means and the base portion is detachable from the medial portion via second detaching means. When the upper sleeve portion and the base portion are detached from the medial portion, the medial portion is attachable to a surface of the plant container via the bonding material forming a skirt which extends away from the upper end of the plant container.

The invention further contemplates a method of covering a plant container, comprising the steps of: (1) providing a plant container having an upper end, a lower end, an outer surface, an inner surface, and an interior space, and having a floral grouping disposed within the interior space and extending a distance above the upper end of the plant container, (2) disposing the plant container into a flexible tubular sleeve having an upper portion, a base portion, and a medial portion, the medial portion positioned between the upper portion and the base portion, wherein the base portion substantially encompasses the plant container and the upper portion substantially encompasses the floral grouping, (3) detaching the upper portion and the base portion from the medial portion, and (4) attaching the medial portion to a surface of the plant container wherein the medial portion forms a skirt extending away from the upper end of the plant container. The medial portion may be attached via bonding means or via banding means.

In another version, steps 3 and 4 may be reversed wherein the medial portion is first attached to a surface of the plant container, and the upper portion and the base portion are then detached from the medial portion wherein the medial portion forms a skirt extending away from the upper end of the plant container.

Shown in FIG. 1 and designated by the general reference numeral 10 is a tubular floral sleeve constructed in accordance with the present invention. The sleeve 10 has an upper end 12, a lower end 14, and an outer peripheral surface 16. The lower end 14 may be open or closed. If closed, the lower end 14 may have a straight sealed edge or a gusset or excess material for allowing expansion of the lower end. The sleeve 10 further comprises an upper portion 18, a lower portion 20 and a medial portion 22 disposed between the upper portion 18 and the lower portion 20. The upper portion 18 is detachable from the upper end of the medial portion 22 via upper detaching means 24 which in a preferred embodiment is a plurality of perforations. The lower portion 20 is detachable from the lower end of the medial portion 22 via lower detaching means 26 which in a preferred embodiment is a plurality of perforations. The detaching means may be perforations, tear strips, zippers, or any other means for detaching which function in accordance with the present invention. The lower detaching means 26 is positioned in the sleeve 10 at a position so that when a pot or floral container is disposed within the sleeve 10, the detaching means 26 is located a distance 27 below the upper rim of the pot so that a portion of the medial portion 22 can be attached to a portion of the outer or inner surface of the pot.

The sleeve 10 preferably further comprises a bonding material 28 disposed upon a portion of the outer peripheral surface 16 as shown in FIG. 1. In those versions having the bonding material, the bonding material 28 is disposed on the medial portion 22 in a position between the upper detaching means 24 and the lower detaching means 26. Equipment and devices for forming sleeves and for forming perforations therein are well known in the art and may be seen in U.S. Pat. No. 5,493,809, the specification of which is hereby incorporated by reference herein.

Figure 2:
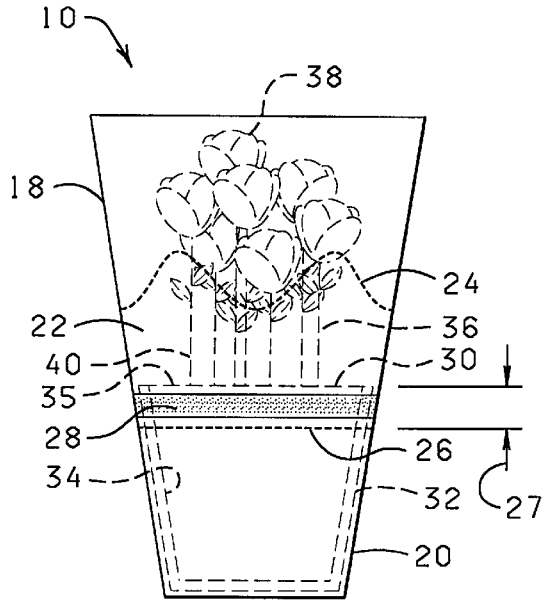
FIG. 2 is a side view of a pot disposed within the sleeve of FIG. 1.

FIG. 2 shows a plant assembly comprising a pot 30 which is contained within the sleeve 10. The pot 30 has an outer surface 32, an inner surface 34, and an upper rim 35. The pot 30 generally contains a floral grouping 36, however, in another embodiment of the invention the pot may be empty or partially empty. As shown in FIG. 2, the area of bonding material 28 on the sleeve 10 preferably is positioned adjacent a portion of the pot 30 near the upper rim 35 thereof. The term "pot", "pot means", or "floral container" as used herein refers to any type of container used for holding a floral grouping or a potted plant. Examples of pots, used in accordance with the present invention include, but are not limited to, clay pots, wooden pots, plastic pots, vases, and the like.

The floral grouping 36 may be disposed within the pot 30, along with a suitable growing medium, which will be described in further detail below, or other retaining medium, such as, but not limited to, a floral foam. The term "floral grouping" as used herein means cut fresh flowers, artificial flowers, a single flower or other fresh and/or artificial plants or other floral materials and may include other secondary plants and/or ornamentation or artificial or natural materials which add to the aesthetics of the overall floral grouping 36. The floral grouping 36 comprises a bloom or foliage portion 38 and a stem portion 40. Further, the floral grouping 36 may comprise a growing plant having a root portion (not shown) as well. However, it will be appreciated that the floral grouping 36 may consist of only a single bloom or only foliage, or a botanical item (not shown), or a propagule (not shown). The term "floral grouping" may be used interchangeably herein with both the terms "floral arrangement" and "potted plant". The term "floral grouping" may also be used interchangeably herein with the terms "botanical item" and/or "propagule."

The term "growing medium" when used herein means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule" when used herein means any structure capable of being propagated or acting as an agent of reproduction including seeds, shoots, stems, runners, tubers, plants, leaves, roots or spores.

It will be understood that the bonding material 28 may be disposed in a solid section of bonding material. Further, the bonding material 28 may be disposed in strips, or spots, or in any other geometric, non-geometric, asymmetric, or fanciful form. The bonding material 28 is disposed on the sleeve 10 and/or pot 30 by any means known in the art such as spraying or brushing.

The sleeve 10 is generally conically shaped, but the sleeve 10 may be, by way of example but not by way of limitation, cylindrical, frusto-conical, or a combination of both frusto-conical and cylindrical (not shown). Further, as long as a generally tubular shape is maintained in at least a portion of the sleeve 10, any shape, whether geometric, non-geometric, asymmetrical and/or fanciful may be utilized.

The sleeve 10 preferably has a thickness in a range from about 0.1 mils to about 30 mils. Often, the thickness of the sleeve 10 is in a range from about 0.5 mils to about 10 mils. Preferably, the sleeve 10 has a thickness in a range from about 0.1 mils to about 5 mils. The sleeve 10 is constructed of a material which is flexible.

The sleeve 10 may be constructed of a single layer of material or a plurality of layers of the same or different types of materials. Any thickness of the material may be utilized in accordance with the present invention as long as the material is wrappable about a pot 30, as described herein. The layers of material comprising the sleeve 10 may be connected together or laminated or may be separate layers. Materials used to construct the sleeve 10 are described in U.S. Pat. No. 5,111,637, which is hereby incorporated herein by reference.

The term "bonding material or means" when used herein means an adhesive, frequently a pressure sensitive adhesive, or a cohesive. Where the bonding material is a cohesive, a similar cohesive material must be placed on the adjacent (e.g., the adjacent surface of the pot 30) surface for bondingly contacting and bondingly engaging with the cohesive material. The term "bonding material or means" also includes materials which are heat sealable and, in this instance, the adjacent portions of the material must be brought into contact and then heat must be applied to effect the seal. The term "bonding material or means" also includes materials which are sonic sealable and vibratory sealable. The term "bonding material or means" when used herein also means a heat sealing lacquer or hot melt material which may be applied to the material and, in this instance, heat, sound waves, or vibrations, also must be applied to effect the sealing.

Alternatively, a cold seal using a cold seal adhesive is utilized upon the material to form a sleeve. The term "bonding material or means" includes this cold seal adhesive. The cold seal adhesive adheres only to a similar substrate, acting similarly as a cohesive, and binds only to itself. The cold seal adhesive, since it adheres (or coheres) only to a similar substrate, does not cause a residue to build up on equipment, thereby permitting much more rapid disposition and use to form articles. A cold seal adhesive differs also from, for example, a pressure sensitive adhesive, in that a cold seal adhesive is not readily releasable.

As noted above, the sleeve 10 may be constructed of a single layer of material or a plurality of layers of the same or different types of materials. Any thickness of layer of material may be utilized in accordance with the present invention as long as the sleeve 10 may be formed into at least a portion of a sleeve 10, as described herein, and as long as the formed sleeve 10 may contain at least a portion of a pot 30 or a floral grouping 36, as described herein. Additionally, an insulating material such as bubble film, preferable as one of two or more layers, can be utilized in order to provide additional protection for the item, such as the floral grouping 36, contained therein.

Where used herein, the term "banding means" refers to elastic or plastic bands, ties, strings, ribbons, collars, or other similar tying or banding materials.

In one embodiment, the sleeve 10 may be constructed from two polypropylene films. The layers of material comprising the sleeve 10 may be connected together or laminated or may be separate layers. In an alternative embodiment, the sleeve 10 may be constructed from only one of the polypropylene films.

The sleeve 10 is constructed from any suitable material and preferably, comprises paper (untreated or treated in any manner), cellophane, metal foil, polymer film, non-polymer film, fabric (woven or nonwoven or synthetic or natural), cardboard, fiber, cloth, burlap, or laminations or combinations thereof.

The term "polymer film" means a man-made polymer such as a polypropylene or a naturally occurring polymer such as cellophane. A polymer film is relatively strong and not as subject to tearing (substantially non-tearable), as might be the case with paper or foil.

The material comprising the sleeve 10 may vary in color. Further, the material comprising the sleeve 10 may consist of designs or decorative patterns which are printed, etched, and/or embossed thereon using inks or other printing materials. An example of an ink which may be applied to the surface of the material is described in U.S. Pat. No. 5,147,706 which is hereby incorporated herein by reference.

In addition, the sleeve material may have various colorings, coatings, flocking and/or metallic finishes, or other decorative surface ornamentation applied separately or simultaneously or may be characterized totally or partially by pearlescent, translucent, transparent, iridescent or the like, qualities. Each of the above-named characteristics may occur alone or in combination and may be applied to the upper and/or lower surface of the material comprising the sleeve 10. Moreover, each surface of the material used in constructing the sleeve 10 may vary in the combination of such characteristics. The material utilized for the sleeve 10 itself may be opaque, translucent, transparent, or partially clear or tinted transparent.

The sleeve 10 may further comprise one or more apertures 42 near the upper end. The apertures 42 permit the sleeve 10, to be placed on a rod or a set of rods, also known as wickets, for shipment, storage, assembly or use of the sleeve 10. The medial portion 22 may be formed so as to turn upwardly, inwardly, horizontally (upward or inward), downwardly, vertically (either upward or downward) or in any combination thereof, or in any obtuse or arbitrary angle or combination thereof. The sleeves may also be packed so each sleeve is separate, or may be stapled together.

Figure 3:
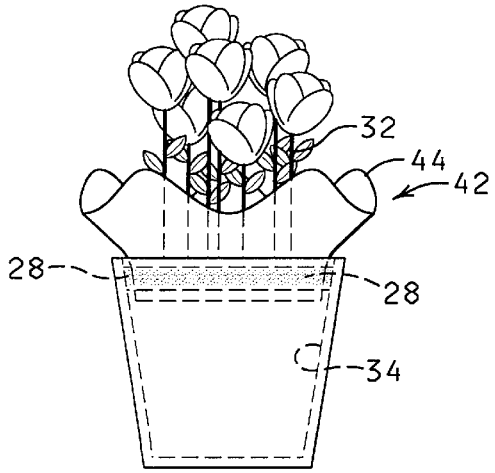
FIG. 3 is a side view of a pot having a skirt attached thereto.

In usage a plant container such as the pot 30 containing the floral grouping 36 is disposed within the sleeve 10. The plant package thus assembled can be stored, shipped or sold. If desired by the grower, shipper, seller or buyer, the upper portion 18 and the lower portion 20 of the sleeve 10 can be detached via the detaching means 24 and 26, respectively, leaving the medial portion 22 disposed as a skirt about the pot 30. As shown in FIG. 3, the free medial portion 22 can then be bondingly connected to a portion of the pot 30 near the upper end thereof. In the case of sleeve 10, where the bonding material 28 is disposed on the outer peripheral surface 16, the medial portion 22 is attached by the bonding material 28 to a portion of the inner surface 34 of the pot 30. A portion of the medial portion 22 then extends from the upper end of the pot 30 and forms a decorative skirt 42 about a portion of the floral grouping 36. Where the bonding material 28 is a cohesive material, the pot 30 also has a similar cohesive material on a portion thereof for connecting to the cohesive bonding material 28 on the sleeve 10. Thus, in the embodiment of the present invention shown in FIG. 3, the outer surface 32 of the pot 30 is exposed, and at least the bloom portion 38 of the floral grouping 36 is exposed.

Figure 4:
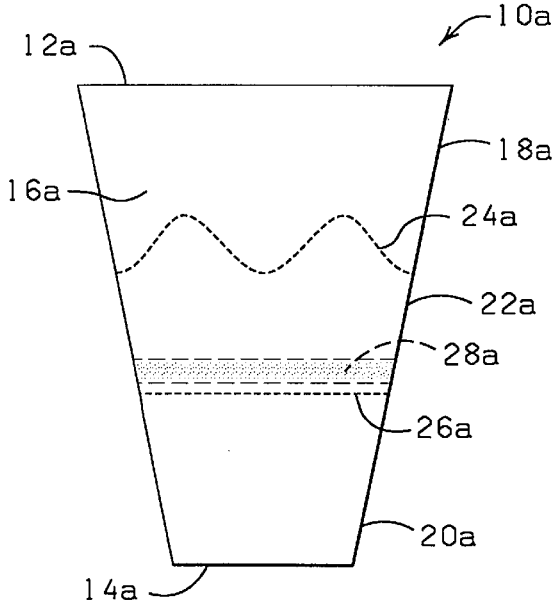
FIG. 4 is a side perspective view of another sleeve constructed in accordance with the present invention.
Figure 5:
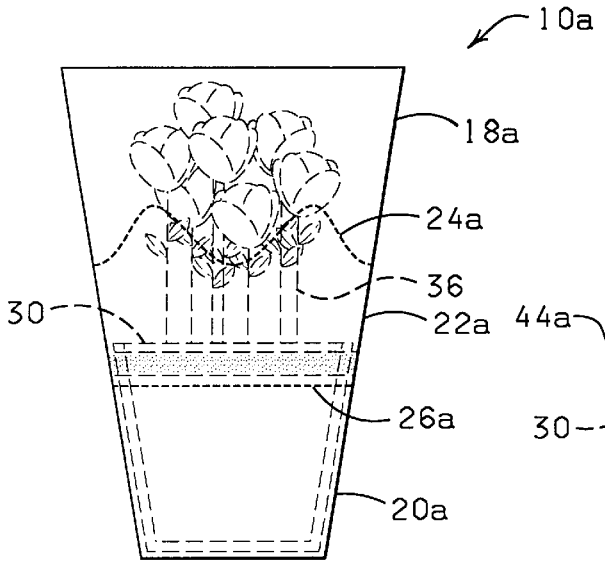
FIG. 5 is a side view of a pot disposed within the sleeve of FIG. 4.
Figure 6:
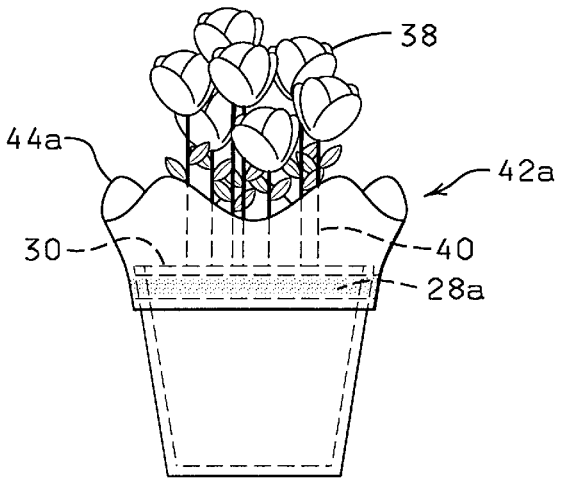
FIG. 6 is a side view of another embodiment of a pot having a skirt attached thereto.

An alternative embodiment of the invention is shown in FIG. 4 as sleeve 10*a*. Sleeve 10*a* is exactly the same as sleeve 10 described previously except that sleeve 10*a* has a bonding material 28*a* disposed on a portion of the inner surface of the medial portion 22*a* of the sleeve 10*a*. FIG. 5 shows the sleeve 10*a* disposed about a pot 30 in a similar manner as shown in FIG. 3 except the bonding material 28*a* is immediately adjacent to a portion of the outer surface 32 of the pot 30 and the bonding material 28*a* bondingly connects the medial portion 22*a* of the sleeve 10*a* to a portion of the outer surface 32 of the pot 30 near the upper end thereof. As with the sleeve 10 shown in FIGS. 1–3, an upper portion 18*a* and lower portion 20*a* can be detached via detaching means 24*a* and 26*a*, respectively, leaving the medial portion 22*a* in a position about the pot 30 and bondingly connected to the outer surface 32 thereof, via the bonding material 28*a*. A portion of the medial portion 22*a* extends away from the pot 30 comprising a decorative skirt 42*a* as shown in FIG. 6. The medial portion 22*a* of the sleeve loa may be bondingly connected to the pot 30 either before, or after the detachment of the upper portion 18*a* and lower portion 20*a*.

In both embodiments shown in FIGS. 3 and 6, an upper edge 44 and 46 is formed in the skirts 42 and 42*a*, when the upper portions 18 and 18*a* are detached therefrom, respectively. The upper edges 44 and 44*a* may be linear, or may be curved (non-linear). The upper edges 44 and 44*a* may have a scalloped pattern, an inverted scalloped pattern, a sine wave pattern, a crenulated pattern or any other appropriate form. The skirt portion 42*a*, like the skirt portion 42, does not completely or substantially surround the floral grouping 36 but generally extends only near a lower portion of the floral grouping 36 for decorating the pot and floral grouping without covering the upper portion of the floral grouping and also for providing a border about the pot for reducing spillage of water or growing medium from the pot.

Figure 7:
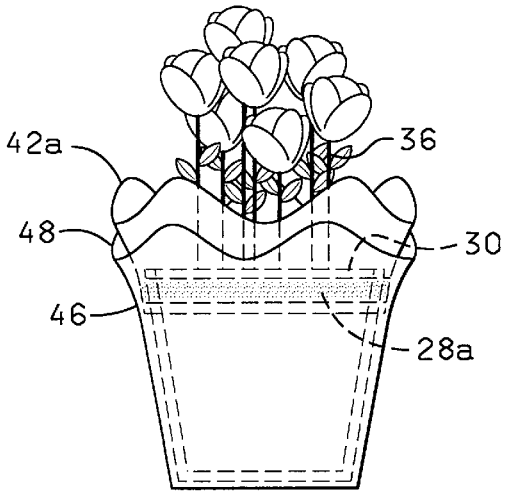
FIG. 7 is a side view of a skirt and pot such as shown in FIG. 6 with a decorative cover applied thereto.

Shown in FIG. 7 is an alternative embodiment of the invention wherein a pot 30 having a skirt 42*a* attached thereto, such as is shown in FIG. 6, has a pot cover 46 disposed thereabout to further cover or decorate the pot 30. The cover 46 may comprise a skirt portion 48 for providing a double skirt effect as shown in FIG. 7, or the cover 46 may be constructed from the same material as the skirt 42*a*, or from a different material for providing a different decorative effect.

Figure 8:
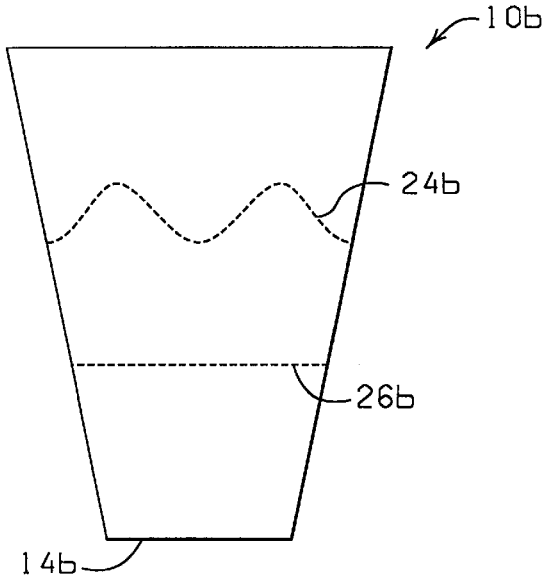
FIG. 8 is a side perspective view of another sleeve constructed in accordance with the present invention.
Figure 1:
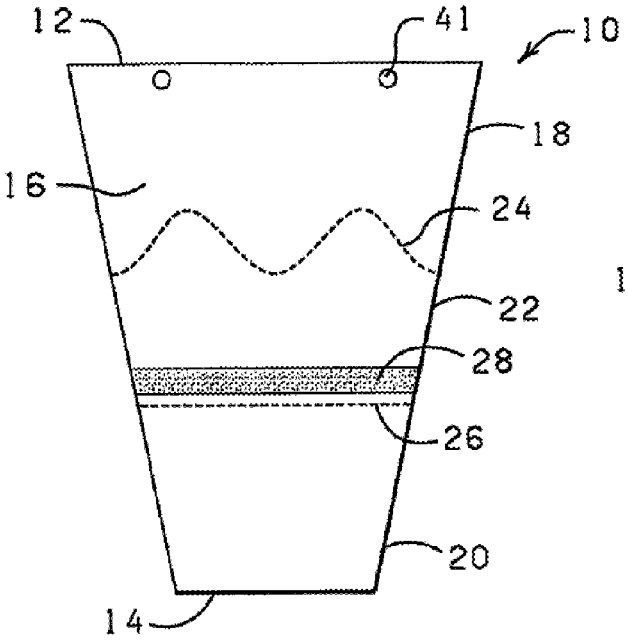
Figure 2:
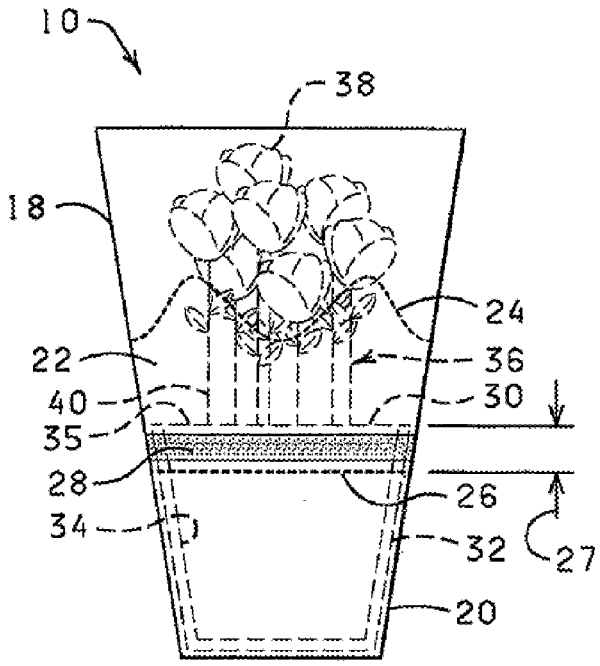
Figure 3:
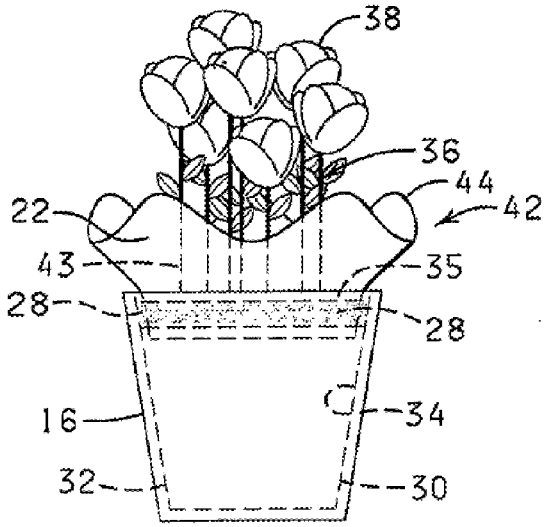
Figure 4:
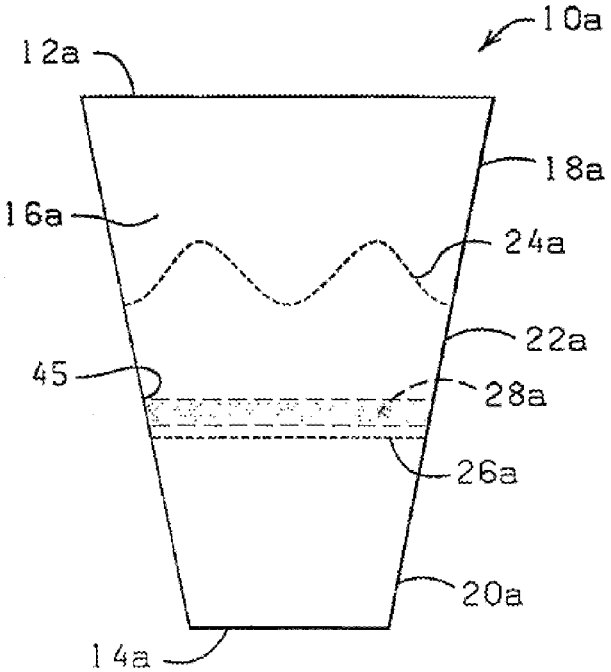
Figure 5:
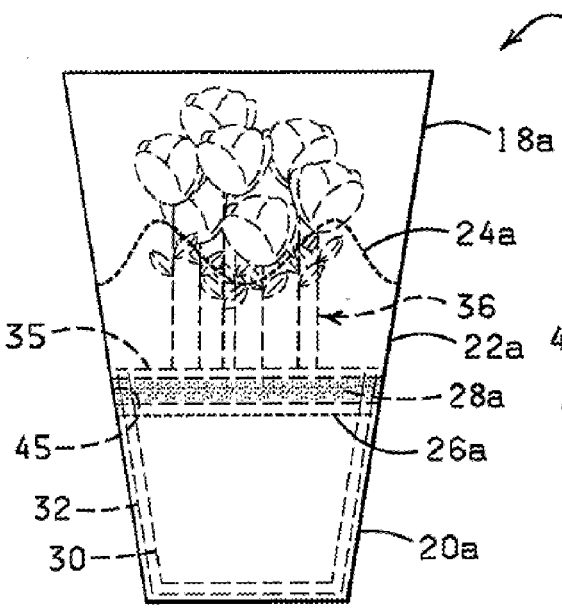
Figure 6:
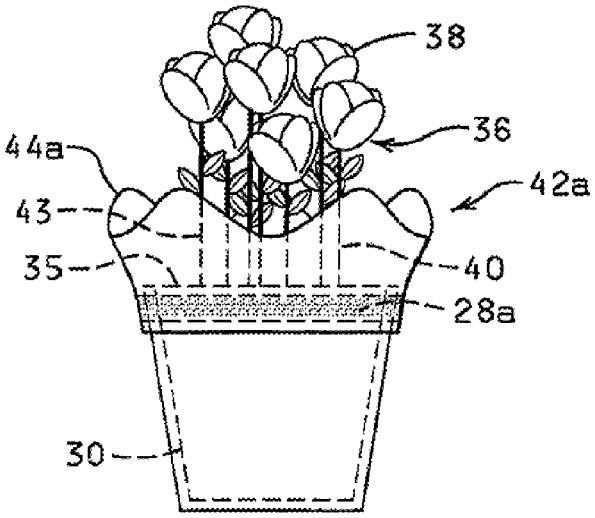
Figure 7:
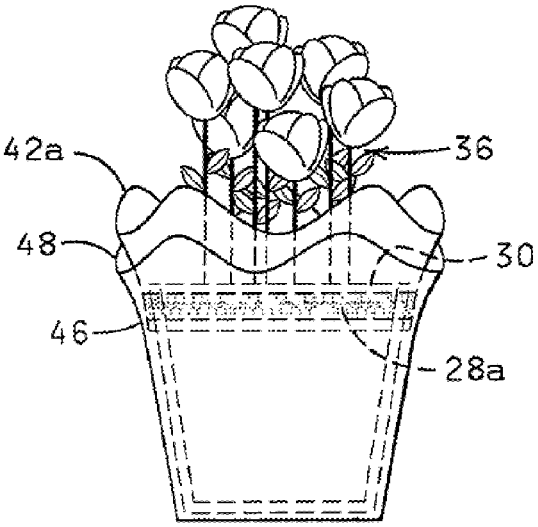
Figure 8:
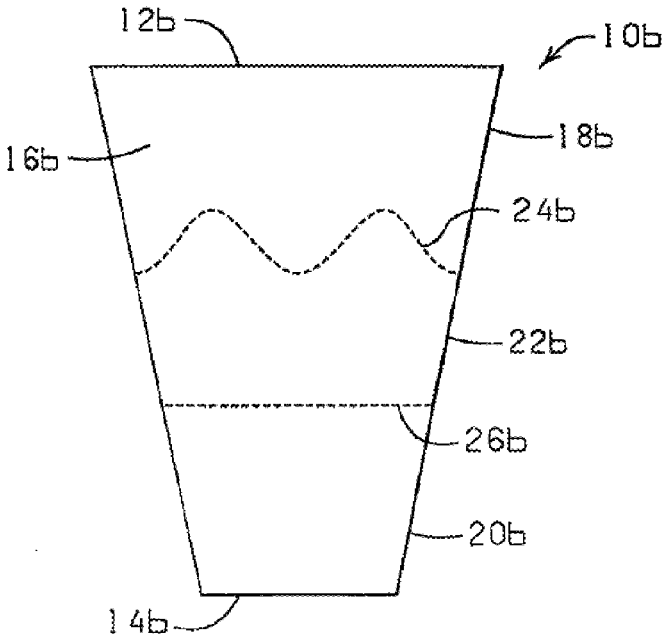

In alternative embodiments, instead of attaching the medial portion to the plant container via a bonding material, the medial portion may be attached to the plant container using a banding means such as a tie, ribbon or band. The banding means may be pre-connected to the sleeve or may comprise a component separate from the sleeve. FIG. 8 shows a floral sleeve 10*b* substantially the same as the sleeves described above but which is not equipped with a bonding material thereon. Sleeve 10*b* has a closed lower end 14*b*, upper detaching means 24*b* and lower detaching means 26*b*. The sleeve 10*b* is sized and dimensioned to fit a specific pot or floral container having specific dimensions. The lower detaching means 26*b* of the sleeve 10*b* is positioned on the sleeve 10*b* so that it will be located a distance below the upper rim of the floral container which the sleeve 10*b* has been designed to fit.

Changes may be made in the construction and the operation of the various components, elements and assemblies described herein or in the steps or the sequence of steps of the methods described herein without departing from the spirit and scope of the invention as defined in the following claims.

What is claimed is:

1. A method of providing a covering for a plant container, comprising:

providing a plant container having an upper end, a lower end, an outer surface, an inner surface, and an interior space, and having a floral grouping disposed within the interior space and extending a distance above the upper end of the plant container;

disposing the plant container into a flexible tubular sleeve having an upper portion, a base portion, and a medial portion, the medial portion positioned between the upper portion and the base portion wherein the base portion substantially encompasses the plant container and the upper portion substantially encompasses the floral grouping;

detaching the upper portion and the base portion from the medial portion; and attaching the medial portion to a portion of an inner surface of the plant container wherein the medial portion forms a skirt extending away from the upper end of the plant container.

2. A method of providing a covering for a plant container, comprising:

providing a plant container having an upper end, a lower end, an outer surface, an inner surface, and an interior space, and having a floral grouping disposed within the interior space and extending a distance above the upper end of the plant container;

disposing the plant container into a flexible tubular sleeve having an upper portion, a base portion, and a medial portion, the medial portion positioned between the upper portion and the base portion wherein the base portion substantially encompasses the plant container and the upper portion substantially encompasses the floral grouping;

attaching the medial portion to a portion of an inner surface of the plant container; and detaching the upper portion and the base portion from the medial portion wherein the medial portion forms a skirt extending away from the upper end of the plant container.

3. A method of providing a decorative skirt for a plant container, having an upper rim, comprising:

providing a wrapper comprising:

a flexible flattened tubular sleeve having an upper end, a lower end, an outer peripheral surface, an inner peripheral surface and an interior space, and having an upper sleeve portion, a base portion and a medial portion positioned between the upper sleeve portion and the base portion, and wherein the upper sleeve portion is detachable from the medial portion via upper detaching means and wherein the base portion is detachable from the medial portion via lower detaching means;

disposing the wrapper about the plant container in a position wherein the upper detaching means is positioned a distance above the upper rim of the plant container and the lower detaching means is positioned a distance below the upper rim of the plant container and wherein when the upper sleeve portion is detached from the medial portion and the base portion is detached from the medial portion, a portion of the medial portion extends above the upper rim of the plant container and a portion of the medial portion extends a distance below the upper rim of the plant container; and attaching the medial portion to a portion of an inner surface of the plant container.

4. A method of providing a covering for a plant container, comprising:

providing a plant container having an upper end, a lower end, an outer surface, an inner surface, and an interior space, and having a floral grouping disposed within the interior space and extending a distance above the upper end of the plant container;

disposing the plant container into a flexible tubular sleeve having an upper portion, a base portion, and a medial portion, the medial portion positioned between the upper portion and the base portion wherein the base portion substantially encompasses the plant container and the upper portion substantially encompasses the floral grouping;

attaching the medial portion to a surface of the plant container; and detaching the upper portion and the base portion from the medial portion wherein the medial portion forms a skirt extending away from the upper end of the plant container.

5. The method of claim 4 wherein in the attaching step the medial portion is attached to a portion of an outer surface of the plant container.

6. The method of claim 4 wherein in the attaching step the medial portion is attached to the plant container via an adhesive or cohesive bonding material.

7. The method of claim 4 wherein in the attaching step the medial portion is attached to the plant container via a banding means.

8. The method of claim 4 wherein in the attaching step the medial portion is attached to the plant container near the upper end thereof.

9. A method of providing a decorative skirt for a plant container, having an upper rim, comprising:

providing a wrapper comprising:

a flexible flattened tubular sleeve having an upper end, a lower end, an outer peripheral surface, an inner peripheral surface, and an interior space, and having an upper sleeve portion, a base portion and a medial portion positioned between the upper sleeve portion and the base portion, and wherein the upper sleeve portion is detachable from the medial portion via upper detaching means and wherein the base portion is detachable from the medial portion via lower detaching means, and disposing the wrapper about the plant container in a position wherein the upper detaching means is positioned a distance above the upper rim of the plant container and the lower detaching means is positioned a distance below the upper rim of the plant container and wherein when the upper sleeve portion is detached from the medial portion and the base portion is detached from the medial portion, a portion of the medial portion extends above the upper rim of the plant container and a portion of the medial portion extends a distance below the upper rim of the plant container.

10. The method of claim 9 comprising the additional step of attaching the medial portion to a portion of an outer surface of the plant container.

11. The method of claim 9 comprising the additional step of attaching the medial portion to the plant container via an adhesive or cohesive bonding material.

12. The method of claim 10 wherein in the attaching step the medial portion is attached to the plant container via a banding means.

13. A method of providing a covering for a plant container, comprising:

providing a plant container having an upper end, a lower end, an outer surface, an inner surface, and an interior space, and having a floral grouping disposed within the interior space and extending a distance above the upper end of the plant container;

disposing the plant container into a flexible tubular sleeve having an upper portion, a base portion, and a medial portion, the medial portion positioned between the upper portion and the base portion wherein the base portion substantially encompasses the plant container and the upper portion substantially encompasses the floral grouping;

detaching the upper portion and the base portion from the medial portion; and attaching the medial portion to a surface of the plant container wherein the medial portion forms a skirt extending away from the upper end of the plant container.

14. The method of claim 13 wherein in the attaching step the medial portion is attached to the plant container via a banding means.

15. The method of claim 13 wherein in the attaching step the medial portion is attached to a portion of an outer surface of the plant container.

16. The method of claim 13 wherein in the attaching step the medial portion is attached to the plant container near the upper end thereof.

17. The method of claim 13 wherein in the attaching step the medial portion is attached to the plant container via an adhesive or cohesive bonding material.

* * * * *

UNITED STATES PATENT AND TRADEMARK OFFICE

CERTIFICATE OF CORRECTION

PATENT NO. : 6,006,496
APPLICATION NO. : 09/004324
DATED : December 28, 1999
INVENTOR(S) : Donald E. Weder It is certified that error appears in the above-identified patent and that said Letters Patent is hereby corrected as shown below:

The title page should be deleted and substitute therefore the attached title page.

Drawings:

Delete Drawing Sheets 1-2, and substitute therefore the Drawing sheets, consisting of Figs. 1-8, as shown on the attached pages.

Column 1:
Line 30, please delete “perspective view” and substitute therefor --elevational representation--.
Line 32, please delete “view” and substitute therefor --elevational representation--.
Line 34, please delete “view” and substitute therefor --pictorial representation--.
Line 36, please delete “perspective view” and substitute therefor --elevational representation--.
Line 38, please delete “view” and substitute therefor --pictorial representation--.
Line 40, please delete “view” and substitute therefor --pictorial representation--.
Line 42, please delete “view of a” and substitute therefor --pictorial representation of the--.
Line 42, please delete “such as”.
Line 45, please delete “perspective view” and substitute therefor --elevational representation--.
Line 50, please delete “such”.
Line 52, after “decorative” please insert --use--.
Line 63, before “upper” please insert --an--.
Line 64, please delete “means” and substitute therefor --element,--.
Line 65, after “via” please insert --a--.
Line 65, delete “means” and substitute therefor --element--.
Line 66, delete “means” and substitute therefor --element--.
Line 67, delete “means” and substitute therefor --element--.

UNITED STATES PATENT AND TRADEMARK OFFICE

CERTIFICATE OF CORRECTION

PATENT NO. : 6,006,496
APPLICATION NO. : 09/004324
DATED : December 28, 1999
INVENTOR(S) : Donald E. Weder It is certified that error appears in the above-identified patent and that said Letters Patent is hereby corrected as shown below:

Column 2:
Line 6, after "container" please insert --, thereby--.
Line 7, please delete "means" and substitute therefor --element--.
Line 8, please delete "means" and substitute therefor --element--.
Line 9, after "The lower end" please insert --of the sleeve--.
Line 16, after "peripheral surface," please delete "and".
Line 22, before "first detaching" please insert --a--.
Line 23, please delete "means" and substitute therefor --element--.
Line 24, please delete "means" and substitute therefor --element--.
Line 47, please delete both occurrences of the term "means" and substitute therefor --material--.
Line 60, after "sealed edge" please insert a comma and delete "or".
Line 61, after "lower end" please insert --14--.
Line 65, after "via" please insert --an--.
Line 66, please delete "means" and substitute therefor --element--.

Column 3:
Line 1, after "via" please insert --a--.
Line 1, please delete "means" and substitute therefor --element--.
Line 2, please delete "means" and substitute therefor --elements 24 and 26--.
Line 5, please delete "means" and substitute therefor --element--.
Line 7, please delete "means" and substitute therefor --element--.
Line 8, after "distance 27" please delete "below the upper rim of the pot" and substitute therefor --(Figure 2) below an upper rim 35 of a pot 30--.
Line 10, after "portion of" please delete "the outer or inner surface of the pot" and substitute therefor --an outer surface 32 or an inner surface 34 of the pot 30--.
Line 16, please delete both occurrences of "means" and substitute therefor --element--.
Line 25, after "the pot" please insert --30--.
Line 29, please delete "pot means" and substitute therefor --"plant container"--.

Column 4:
Line 23, please delete the first occurrence of "mils" and substitute therefor --mil--.
Line 24, please delete the first occurrence of "mils" and substitute therefor --mil--.
Line 26, please delete the first occurrence of "mils" and substitute therefor --mil--.
Line 38, please delete "or means".
Line 39, please delete "means" and substitute therefor --includes--.
Line 44, please delete "or means".
Line 48, please delete "or means".
Line 50, please delete "or means".
Line 57, please delete "or means".

UNITED STATES PATENT AND TRADEMARK OFFICE

CERTIFICATE OF CORRECTION

PATENT NO. : 6,006,496
APPLICATION NO. : 09/004324
DATED : December 28, 1999
INVENTOR(S) : Donald E. Weder It is certified that error appears in the above-identified patent and that said Letters Patent is hereby corrected as shown below:

Column 5:
Line 5, after "portion of" please delete "a" and substitute therefor --the--.
Line 6, after "30 or" please delete "a" and substitute therefor --the--.
Line 11, please delete "means" and substitute therefor --element--.
Line 22, please delete "cellophane,".
Line 52, please delete "42" and substitute therefor --41--.
Line 52, please delete "42" and substitute therefor --41--.
Line 52, please delete the comma after "permit the sleeve 10".
Line 67, please delete "means" and substitute therefor --elements--.

Column 6:
Line 4, please delete "end" and substitute therefor --rim 35--.
Line 9, please delete "end" and substitute therefor --rim 35--.
Line 18, please delete "FIG. 4" and substitute therefor --Figures 4 and 5--.
Line 20, please delete "the" and substitute therefor --an--.
Line 21, after "surface" insert --45--.
Line 22, after "disposed about" please delete "a" and substitute therefor --the--.
Line 24, after "immediately adjacent" please delete "to".
Line 28, please delete "end" and substitute therefor --rim 35--.
Line 30, please delete "means" and substitute therefor --elements--.
Line 36, please delete "loa" and substitute therefor --10a--.
Line 36, please delete the comma after "either before".
Line 46, please delete "46" and substitute therefor --44a--.
Line 48, after "lower portion" please insert --43--.
Line 49, after "decorating the pot" please insert --30--.
Line 49, after "grouping" please insert --36--.
Line 50, please delete "upper portion" and substitute therefor --bloom portion 38--.
Line 50, after "floral grouping" please insert --36--.
Line 51, after "about the pot" please insert --30--.
Line 52, after "from the pot" please insert --30--.
Line 54, please delete "a pot 30 having a skirt" and substitute therefor --the pot 30 having the skirt--.
Line 57,after "The" please insert --pot--.
Line 65, please delete the term "means" and substitute therefor --element--.
Line 66, please delete the term "means" and substitute therefor --element--.

UNITED STATES PATENT AND TRADEMARK OFFICE

CERTIFICATE OF CORRECTION

PATENT NO. : 6,006,496
APPLICATION NO. : 09/004324
DATED : December 28, 1999
INVENTOR(S) : Donald E. Weder It is certified that error appears in the above-identified patent and that said Letters Patent is hereby corrected as shown below:

Column 7:
Lines 4 and 5, please delete "upper detaching means 24b and lower detaching means 26b" and substitute therefor --an upper detaching element 24b and a lower detaching element 26b--.
Line 7, please delete "means" and substitute therefor --element--.

In the claims:

Claim 1:
Line 3, please delete " end, a lower" and substitute therefor --rim--.
Line 4, please delete "end" and "and an interior".
Line 5, please delete "space".
Line 6, please delete "interior space" and substitute therefor --plant container rim--.
Line 7, please delete "end" and substitute therefore --rim--.
Line 9, please delete "base" and substitute therefor --lower--.
Line 10, after "medial portion" insert --of the sleeve--.
Line 11, please delete both occurrences of "base" and substitute therefor --lower--.
Line 11, after "lower portion" insert --of the sleeve--.
Line 12, after "portion" insert --of the sleeve--.
Line 13, after "upper portion" insert --of the sleeve--.
Line 14, please delete "base" and substitute therefor --lower--.
Line 14, after "lower portion" insert --of the sleeve--.
Line 15, after "medial portion" insert --of the sleeve--.
Line 16, after "lower portion" insert --of the sleeve--.
Line 18, after "portion" insert --of the sleeve--.
Line 19, please delete "end" and substitute therefore --rim--.

Claim 4:
Line 3, please delete "end, a lower" and substitute therefor --rim,--.
Line 4, please delete "end, an outer surface, an inner surface, and an interior" and substitute therefor --an outer surface and an inner surface--.
Line 5, please delete "space".
Line 6, please delete "interior space" and substitute therefor --plant container--.
Line 7, please delete "end" and substitute therefor --rim--.
Line 9, please delete "base" and substitute therefor --lower--.
Line 10, after "medial portion" insert --of the sleeve--.
Line 11, after "base portion" insert --of the sleeve--.
Line 11, please delete both occurrences of "base" and substitute therefor --lower--.
Line 12, after "portion" insert --of the sleeve--.
Line 13, after "portion" insert --of the sleeve--.

UNITED STATES PATENT AND TRADEMARK OFFICE

CERTIFICATE OF CORRECTION

PATENT NO. : 6,006,496
APPLICATION NO. : 09/004324
DATED : December 28, 1999
INVENTOR(S) : Donald E. Weder It is certified that error appears in the above-identified patent and that said Letters Patent is hereby corrected as shown below:

Claim 4: (cont'd)
Line 15, after "portion" insert --of the sleeve--.
Line 15, please delete "a" and substitute therefor --at least one of the inner surface and the outer--.
Line 17, after "base portion" insert --of the sleeve--.
Line 17, please delete "base" and substitute therefor --lower--.
Line 18, after both occurrences of "portion" insert --of the sleeve--.
Line 19, please delete "end" and substitute therefor --rim--.

Claim 5:
Line 2, after "medial portion" insert --of the sleeve--.
Line 2, please delete "an"

Claim 6:
Line 2, after "medial portion" insert --of the sleeve--.

Claim 7:
Line 2, after "medial portion" insert --of the sleeve--.

Claim 8:
Line 2, after "medial portion" insert --of the sleeve--.
Line 3, please delete "end" and substitute therefor --rim--.

Claim 9:
Line 2, please delete first occurrence of ",".
Line 5, after "end," insert --and--.
Line 5, please delete "an inner periph-".
Line 6, please delete "eral surface, and an interior space,".
Line 7, please delete "sleeve".
Line 7, please delete "base" and substitute therefor --lower--.
Line 8, please delete "sleeve".
Line 9, please delete "base" and substitute therefor --lower--.
Line 9, please delete "sleeve".
Line 9, after the second occurrence of "portion" insert --of the sleeve--.
Line 10, after "medial portion" insert --of the sleeve--.
Line 10, after "via" insert --an--.
Line 11, please delete "means" and substitute therefor --element--.

UNITED STATES PATENT AND TRADEMARK OFFICE

CERTIFICATE OF CORRECTION

PATENT NO. : 6,006,496
APPLICATION NO. : 09/004324
DATED : December 28, 1999
INVENTOR(S) : Donald E. Weder It is certified that error appears in the above-identified patent and that said Letters Patent is hereby corrected as shown below:

Claim 9: (cont'd)
Line 11, please delete "base" and substitute therefor --lower--.
Line 11, after "portion" insert --of the sleeve--.
Line 12, after "via" insert --a--.
Line 12, please "means" and substitute therefor --element--.
Line 14, please delete "upper detaching means is posi".
Line 15, please delete "tioned a distance above the upper rim of the plant".
Line 16, please delete "container and the".
Line 16, please delete "means" and substitute therefor --element--.

Column 9:
Line 2, please delete "and wherein" and substitute therefor --such that--.
Line 2, please delete "sleeve portion" and substitute therefor --portion of the sleeve--.
Line 3, after "base portion" insert --of the sleeve--.
Line 3, please delete "base" and substitute therefor --lower--.
Line 4, after "medial portion" insert --of the sleeve,--.
Line 5, after "medial portion" insert --of the sleeve--.
Line 6, after "medial portion" insert --of the sleeve--.

Claim 10:
Line 2, after "medial portion" insert --of the sleeve--.

Claim 11:
Line 2, after "medial portion" insert --of the sleeve--.

Claim 12:
Line 2, after "medial portion" insert --of the sleeve--.
Line 3, please delete "means" and substitute therefor --element--.

Claim 13:
Line 3, please delete "end, a lower" and substitute therefor --rim--.
Line 4, please delete "end".
Line 4, after the first occurrence of "surface," insert --and--.
Line 4, please delete "and an interior".
Line 5, please delete "space".
Line 6, please delete "interior space" and substitute therefor --plant container--.
Line 7, please delete "end" and substitute therefor --rim--.
Line 9, please delete "base" and substitute therefor --lower--.

UNITED STATES PATENT AND TRADEMARK OFFICE

CERTIFICATE OF CORRECTION

PATENT NO. : 6,006,496
APPLICATION NO. : 09/004324
DATED : December 28, 1999
INVENTOR(S) : Donald E. Weder It is certified that error appears in the above-identified patent and that said Letters Patent is hereby corrected as shown below:

Column 10:
Line 1, after “medial portion” insert --of the sleeve--.
Line 2, after “base portion” insert --of the sleeve--.
Line 2, please delete both occurrences of “base” and substitute therefor --lower--.
Line 3, after “portion” insert --of the sleeve--.
Line 4, after “portion” insert --of the sleeve--.
Line 6, please delete “base” and substitute therefor --lower--.
Line 7, after “portion” insert --of the sleeve--.
Line 8, after “portion” insert --of the sleeve--.
Line 10, please delete “end” and substitute therefor --rim--.

Claim 14:
Line 2, after “portion” insert --of the sleeve--.
Line 3, please delete “means” and substitute therefor --element--

Claim 15:
Line 2, after “medial portion” insert --of the sleeve--.
Line 2, please delete “an” and substitute therefor --the--.

Claim 16:
Line 2, after “medial portion” insert --of the sleeve--.
Line 3, please delete “end” and substitute therefor --rim--.

Claim 17:
Line 2, after “medial portion” insert --of the sleeve--.

Signed and Sealed this

Thirty-first Day of October, 2006

JON W. DUDAS
*Director of the United States Patent and Trademark Office*

US006006496A

United States Patent [19]

Weder

[11] Patent Number: 6,006,496

[45] Date of Patent: Dec. 28, 1999

[54] FLORAL SLEEVE CONVERTIBLE INTO A DECORATIVE SKIRT

[75] Inventor: Donald E. Weder, Highland, Ill.

[73] Assignee: Southpac Trust International, Inc.

[21] Appl. No.: 09/004,324

[22] Filed: Jan. 7, 1998

Related U.S. Application Data

[60] Division of application No. 08/781,312, Jan. 9, 1997, abandoned, which is a continuation-in-part of application No. 08/453,719, May 30, 1995, abandoned, which is a continuation of application No. 08/220,852, Mar. 31, 1994, Pat. No. 5,572,851.

[51] Int. Cl.[6] ..... B65B 25/02; B65B 61/18

[52] U.S. Cl. ..... 53/399; 53/390; 53/397; 53/412

[58] Field of Search ..... 53/397, 399, 413, 53/412, 410, 419, 459, 469, 464, 461, 473, 390, 592, 582, 580, 571, 570, 219, 218, 133.8, 133.3, 134.1; 47/72, 66 B, 66 R; 206/423; 383/207, 209; 229/87.01, 87.04, 87.05

[56] References Cited

U.S. PATENT DOCUMENTS

| | | | |
|---|---|---|---|
| Re. 21,065 | 5/1939 | Copeman | 93/2 |
| D. 259,333 | 5/1981 | Charbonneau | D9/306 |
| D. 279,279 | 6/1985 | Wagner | D11/143 |
| D. 301,991 | 7/1989 | Van Saat | D11/149 |
| D. 335,105 | 4/1993 | Ottenwalder et al. | D11/164 |
| D. 368,025 | 3/1996 | Sekerak et al. | D9/305 |
| 524,219 | 8/1894 | Schmidt . | |
| 732,889 | 7/1903 | Paver . | |
| 950,785 | 3/1910 | Pene . | |
| 1,063,154 | 5/1913 | Bergen . | |
| 1,446,563 | 2/1923 | Hughes . | |
| 1,520,647 | 12/1924 | Hennigan . | |
| 1,525,015 | 2/1925 | Weeks . | |
| 1,610,652 | 12/1926 | Bouchard . | |
| 1,697,751 | 1/1929 | Blake | 229/87 |
| 1,863,216 | 6/1932 | Wordingham . | |
| 1,978,631 | 10/1934 | Herrlinger | 91/68 |

(List continued on next page.)

FOREIGN PATENT DOCUMENTS

| | | |
|---|---|---|
| 4231978 | 6/1979 | Australia . |
| 654427 | 1/1965 | Belgium . |
| 0050990 | 5/1982 | European Pat. Off. . |
| 0791543 | 8/1997 | European Pat. Off. . |
| 1376047 | 9/1964 | France . |

(List continued on next page.)

OTHER PUBLICATIONS

"A World of Cut Flower and Pot Plant Packaging" Brochure, Klerk's Plastic Products Manufacturing, Inc., published prior to Mar. 31, 1994, 6 pages.

Chantler & Chantler brochure showing Zipper Sleeve™ and Florasheet®, published prior to Mar. 31, 1994, 2 pages.

"Foil Jackets" brochure, Custom Medallion, Inc., Dec., 1996, 2 pages.

(List continued on next page.)

*Primary Examiner*—James F. Coan
*Attorney, Agent, or Firm*—Dunlap, Codding & Rogers, P.C.

[57] ABSTRACT

A floral sleeve having an upper portion, a lower portion and a medial portion. The floral sleeve can be placed about a plant container such as a potted plant such that the lower portion contains the pot, and the upper portion surrounds the plant. When desired, the upper portion and lower portion can be detached, leaving the medial portion which can be attached to the pot forming a skirt extending from the upper end thereof.

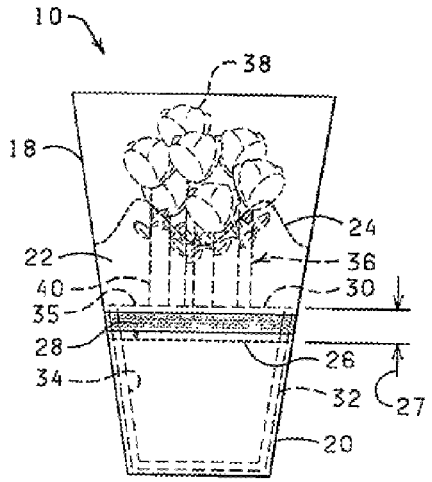

17 Claims, 2 Drawing Sheets